US010694855B2

(12) United States Patent
Zhou et al.

(10) Patent No.: US 10,694,855 B2
(45) Date of Patent: Jun. 30, 2020

(54) ERGONOMIC CHAIR

(71) Applicant: ZHEJIANG MOTOSTUHL FURNITURE CO., LTD, Zhejiang (CN)

(72) Inventors: Jun Zhou, Zhejiang (CN); Daqiu Wang, Zhejiang (CN)

(73) Assignee: ZHEJIANG MOTOSTUHL FURNITURE CO., LTD, Zhejiang (CN)

( * ) Notice: Subject to any disclaimer, the term of this patent is extended or adjusted under 35 U.S.C. 154(b) by 5 days.

(21) Appl. No.: 16/192,825

(22) Filed: Nov. 16, 2018

(65) Prior Publication Data

US 2019/0313802 A1 Oct. 17, 2019

(30) Foreign Application Priority Data

Apr. 12, 2018 (CN) ..... 2018 1 0323197

(51) Int. Cl.
*A47C 7/44* (2006.01)
*A47C 7/46* (2006.01)

(52) U.S. Cl.
CPC ..... *A47C 7/465* (2013.01); *A47C 7/44* (2013.01)

(58) Field of Classification Search
CPC ..... A47C 7/14; A47C 7/465; A47C 7/44
See application file for complete search history.

(56) References Cited

U.S. PATENT DOCUMENTS

| | | | | |
|---|---|---|---|---|
| 5,249,839 | A * | 10/1993 | Faiks | A47C 1/03255 297/284.4 |
| 6,523,898 | B1 * | 2/2003 | Ball | A47C 1/023 297/284.4 |
| 7,226,127 | B1 * | 6/2007 | Yevko | A47C 7/44 297/284.1 |
| 7,568,765 | B2 * | 8/2009 | Brauning | A47C 7/38 297/354.1 |
| 7,712,833 | B2 * | 5/2010 | Ueda | A47C 1/03255 297/296 |
| 8,251,448 | B2 * | 8/2012 | Machael | A47C 7/14 297/299 |
| 9,510,684 | B2 * | 12/2016 | Schmitz | A47C 1/03255 |
| 10,299,595 | B2 * | 5/2019 | Diffrient | A47C 7/44 |
| 2007/0108821 | A1 * | 5/2007 | Ueda | A47C 1/03255 297/301.1 |
| 2016/0135603 | A1 * | 5/2016 | Chan | A47C 7/36 297/284.7 |
| 2019/0045934 | A1 * | 2/2019 | Deisig | A47C 7/14 |

* cited by examiner

*Primary Examiner* — Philip F Gabler
(74) *Attorney, Agent, or Firm* — JCIPRNET

(57) ABSTRACT

An ergonomic chair includes a back component and a seat component. The back component includes an upper back support, a lower back support, a seat back frame that is elastically deformed under traction or squeezing, and a locking mechanism for maintaining positions of the above three components to be relatively fixed. The lower back support is connected to the seat component through a connecting rod. A lower end of the upper back support is rotatably connected to an upper end of the lower back support. Upper and lower ends of the seat back frame are respectively hinged on an upper portion of the back support and the lower portion of the lower back support.

13 Claims, 9 Drawing Sheets

ERGONOMIC CHAIR

CROSS-REFERENCE TO RELATED APPLICATION

This application claims the priority benefit of China application serial no. 201810323197.0 filed on Apr. 12, 2018. The entirety of the above-mentioned patent application is hereby incorporated by reference herein and made a part of this specification.

FIELD OF THE DISCLOSURE

The disclosure relates to the technical field of chair, and in particular to an ergonomic chair.

DESCRIPTION OF RELATED ART

As a chair for people's work and life, office chair has gained public recognition and popularity, and has become one of the indispensable furniture in the modern office and home environment. Currently, the adjustment functions of the office chair back available on the market mainly include backward adjustment, backrest lift adjustment, and lumbar support lift adjustment. Since people's sitting posture is not fixed in the working state, such as leaning forward for writing, sitting with eyes browsing websites at eye-level, the state of the people's back varies, and thus the chair back with fixed angle and shape cannot meet the needs of different sitting postures.

SUMMARY OF THE DISCLOSURE

The disclosure overcomes the deficiencies in the prior art described above, and provides an ergonomic chair capable of adjusting angle or shape of the seat back to fully support back and waist of human body in different sitting postures.

The technical solution of the disclosure is implemented as follows. An ergonomic chair includes a back component and a seat component. The back component includes an upper back support, a lower back support, a seat back frame that is elastically deformed under traction or squeezing, and a locking mechanism for keeping positions of the above three components to be relatively fixed. A lower back support is connected to the seat component through a connecting rod. A lower end of the upper back support is rotatably connected to an upper end of the lower back support. Upper and lower ends of the seat back frame are respectively hinged on an upper portion of the back support and a lower portion of the lower back support. When the locking mechanism is unlocked, the upper back support is rotated, and a straight-line distance of upper and lower hinge points of the seat back frame changes, so that shape and angle of the seat back frame change. When the locking mechanism is locked, the upper back support, the lower back support, and the seat back frame maintain in a relatively fixed posture.

The principles and advantageous effect of the disclosure are described as follows.

The disclosure allows user to adjust the upper back support when unlocking according to different sitting states of different people or the same person. Since the seat back frame is elastic, the straight-line distance between the upper and lower hinge points of the seat back frame can be extended. Forcibly extending a length of the seat back frame allows the upper portion of the back support and the lower back support to be hinged and installed. When the upper back support is rotated by pushing, the seat back frame is rotated and deformed, and the elastic property of the seat back frame serves as a driving force for the upper back support to rotate and restore. When the chair is rotated to a posture and angle suitable for the user, the locking mechanism performs locking.

Furthermore, a mid-lower part of the seat back frame of the disclosure has a shape forwardly arched to form a lumbar support, and whole of the seat back frame is S-shaped so as to fully meet the requirement of ergonomic size. In the meantime, a loose portion in the middle of the mesh is pressed by a pulling base and pulled by a pulling belt, and is stuck in a limiting base, so that the loose portion in the middle of the mesh is in a tight state, and the waist support formed in a mid-lower part of the mesh is also in the tight state, which provides an effective stable support for waist of the human body.

In order to make the aforementioned features and advantages of the disclosure more comprehensible, embodiments accompanying figures are described in detail below.

DESCRIPTION OF EMBODIMENTS

Specific embodiments of the disclosure are as follows.

Embodiment

Figure 16:
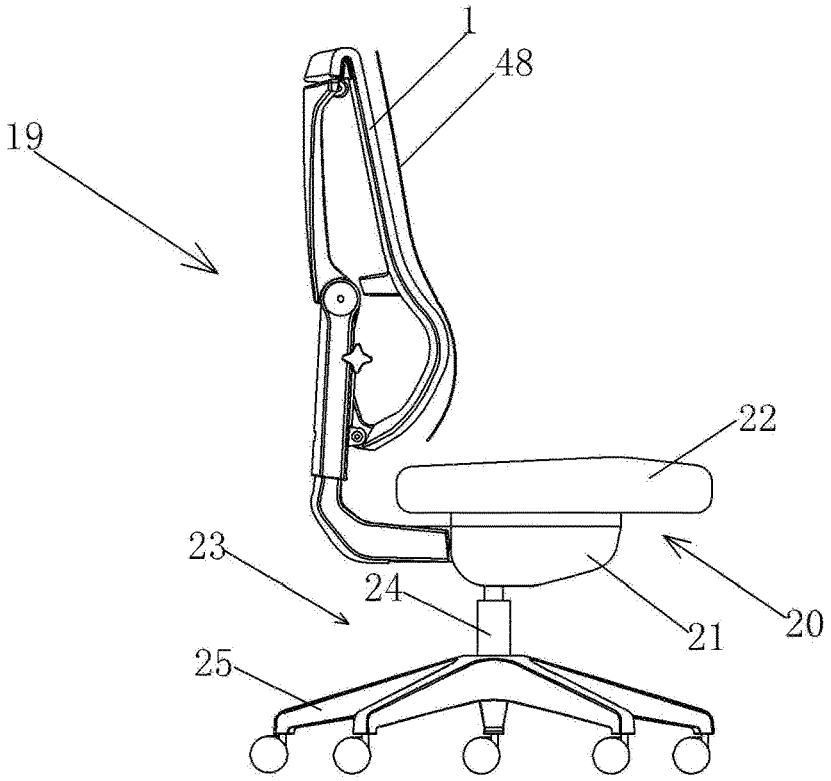
FIG. 16 is a schematic view showing a matching relationship between a human back curve and a curved line of the seat back frame when the back component is not adjusted.
Figure 17:
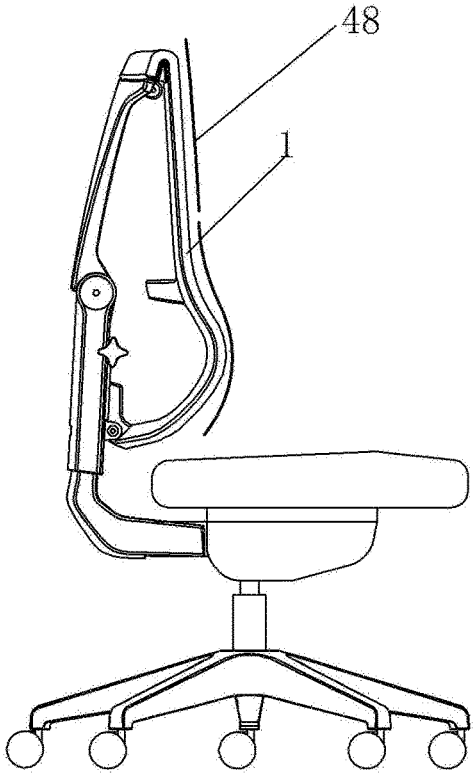
FIG. 17 is a schematic view showing a matching relationship between the human back curve and the curved line of the seat back frame when the back component is adjusted.

An ergonomic chair of the disclosure, as shown in FIG. 16 and FIG. 17, includes a back component 19 and a seat component 20. The seat component 20 includes a base plate 21 and a seat 22 disposed above the base plate 21. A bottom of the base plate 21 is supported by a base component 23 that includes a lifting rod 24 and a five-star leg 25.

Figure 1:
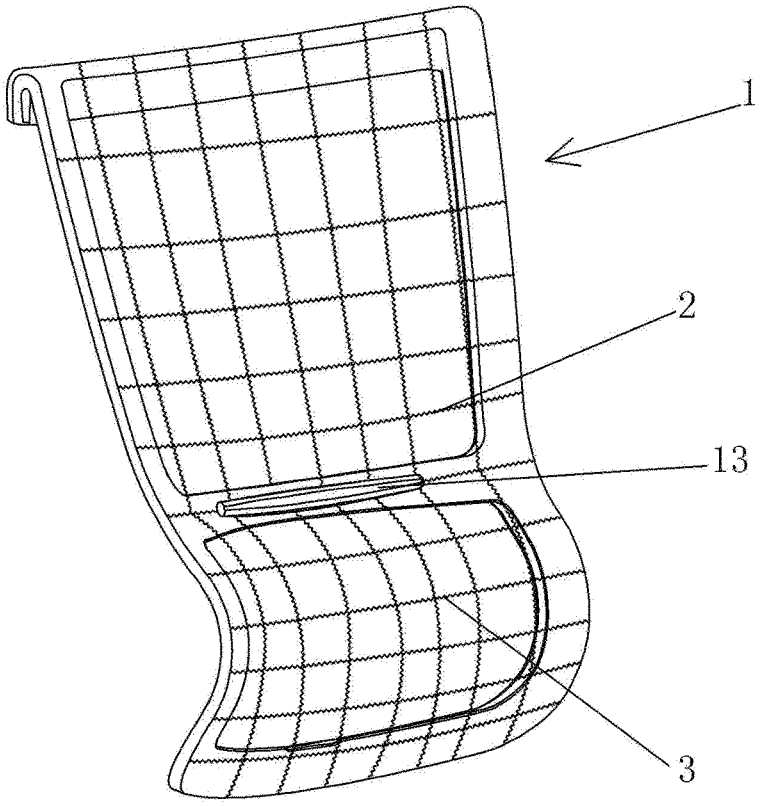
FIG. 1 is a schematic structural view of a seat back frame covered with a mesh according to an embodiment of the disclosure.
Figure 2:
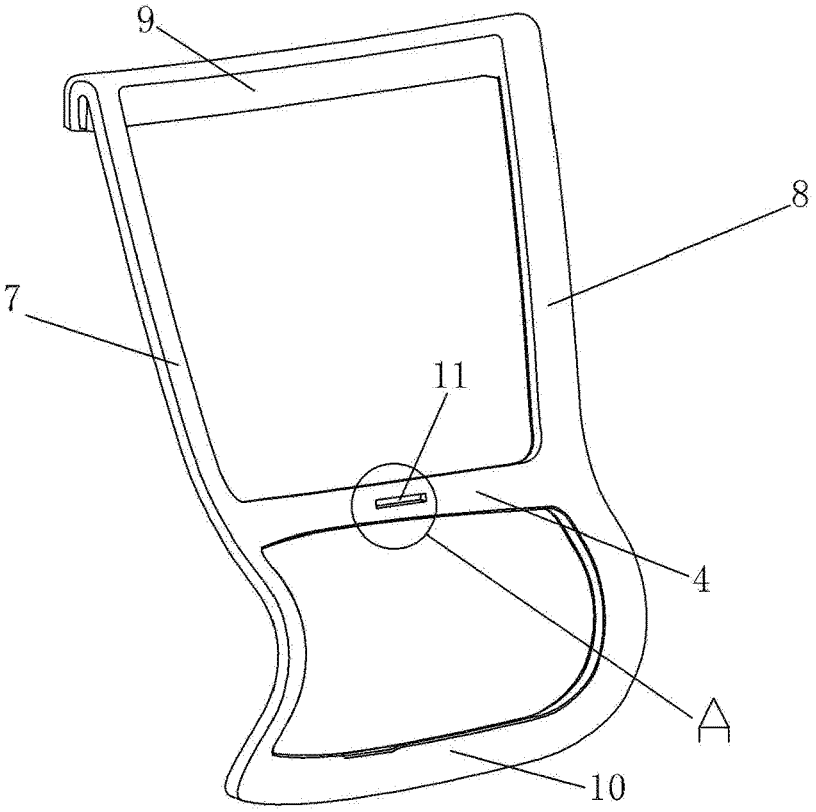
FIG. 2 is a schematic structural view of a seat back frame according to an embodiment of the disclosure.
Figure 3:
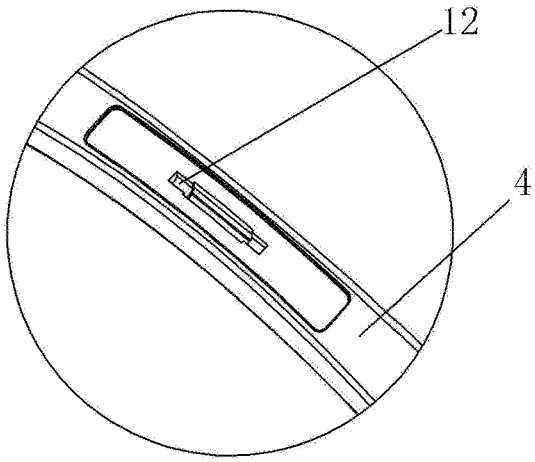
FIG. 3 is a schematic view showing a structural state of an opposite side of a portion (A) in FIG. 2 being connected to a pulling belt.

As shown in FIG. 7 to FIG. 15, the back component 19 includes an upper back support 26, a lower back support 27, a seat back frame 1 elastically deformed under traction or squeezing, and a locking mechanism for maintaining the above three components to be in relatively fixed positions. The seat back frame 1 is plastic injection molded. As shown in FIG. 1, a mesh covers the seat back frame 1, and a slot (not shown) is provided around the seat back frame 1. A periphery of the mesh 2 is fixed in the slot around the seat back frame 1 by an inserting strip (not shown).

The lower back support 27 is connected to the base plate 21 of the seat component 20 via a connecting rod 28, and the connecting rod 28 is an L-shaped connecting rod. A lower end of the upper back support 26 is rotatably connected to an upper end of the lower back support 27. Upper and lower ends of the seat back frame 1 are respectively hinged on an upper portion of the upper back support 26 and a lower portion of the lower back support 27. When the locking mechanism is unlocked, the upper back support 26 is rotated, and a straight-line distance of upper and lower hinge points of the seat back frame 1 is changed, so that shape and angle of the seat back frame 1 are changed. When the locking mechanism is locked, the upper back support 26, the lower back support 27, and the seat back frame 1 are maintained in a relatively fixed posture.

As shown in FIG. 7 to FIG. 12, the locking mechanism includes a limiting block 29, a locking sheet 30, and an adjusting handle 31 for controlling up-down movement of the locking sheet 30. The limiting block 29 is disposed at the lower end of the upper back support 26 and is formed integrally with the upper back support 26. The upper back support 26 has an inverted triangular shape, and the upper back support 26 is composed of two lower vertical edges 32 and one upper lateral edge 33 connected to each other. The limiting block 29 is formed in the manner of extending downward from the lowermost top point of the upper back support 26. Connecting ears 34 are formed in the manner of extending outward from left and right ends of the upper lateral edge 33 respectively. The connecting ears 34 are hinged to an ear portion 35 reserved in an upper portion of the sear back frame 1 through a small shaft, such that firmness and stability of the upper back support 26 may be improved with a simple structure, thereby enhancing esthetic effect. A connecting block 36 is extended backward from a lower end of the seat back frame 1, and the connecting block 36 is hinged to a second small shaft base 51 that is at the lower portion of the lower back support 27 through the small shaft.

Figure 7:
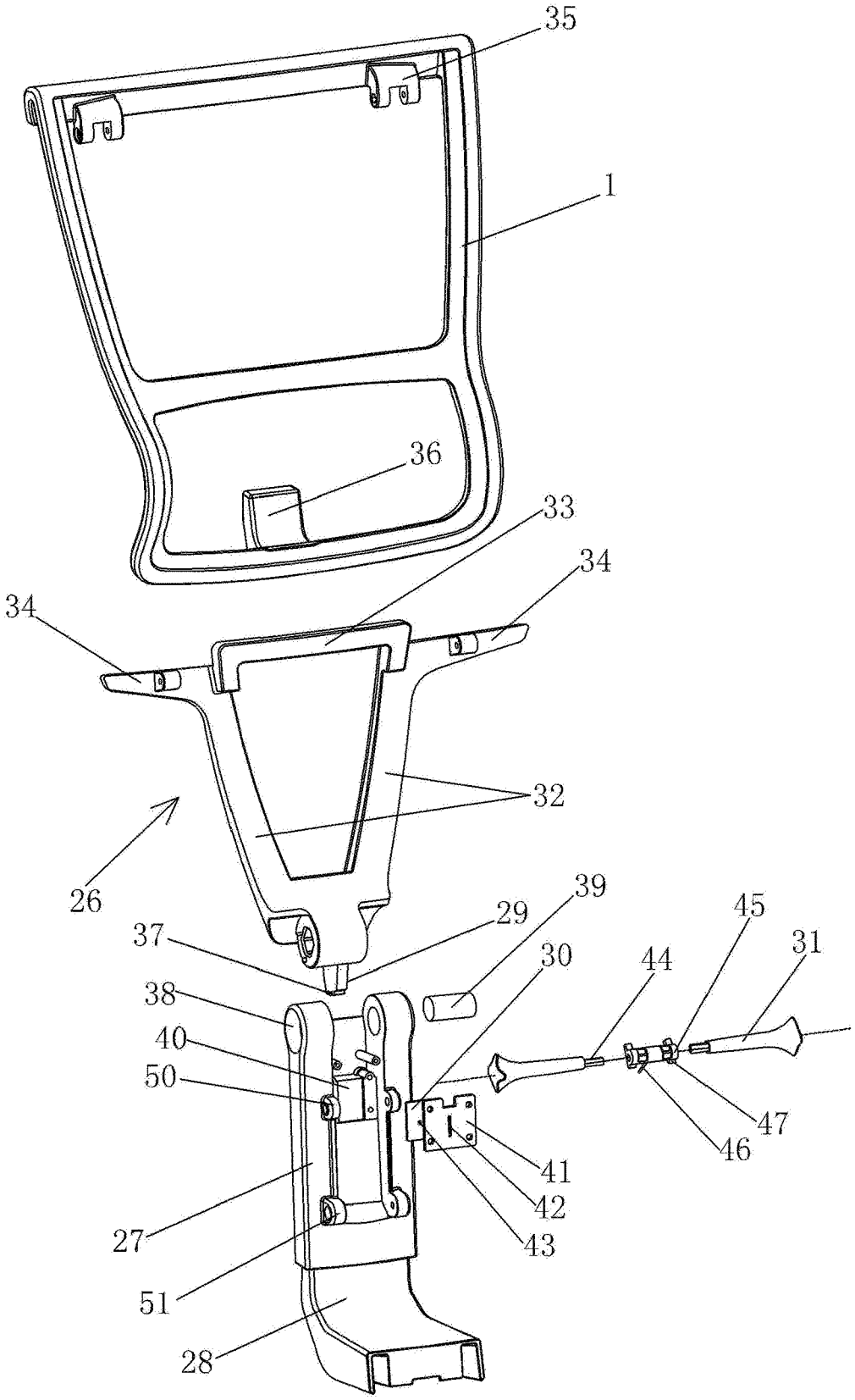
FIG. 7 is a schematic view showing a separated structure of a back component of according to the disclosure.
Figure 8:
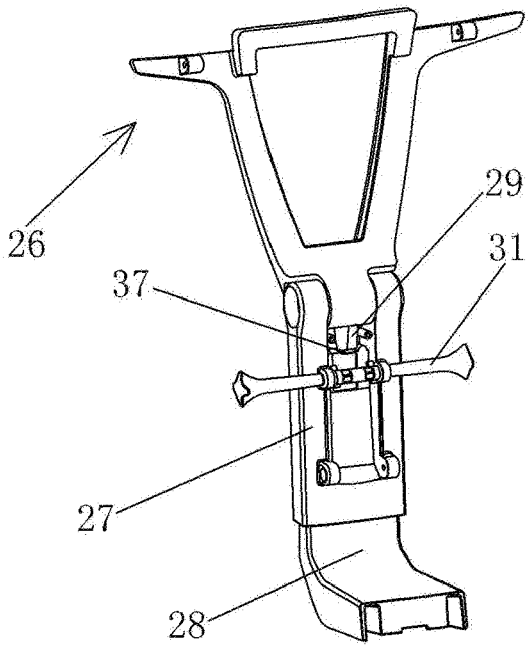
FIG. 8 is a schematic view showing a connection structure of an upper back support and a lower back support.
Figure 9:
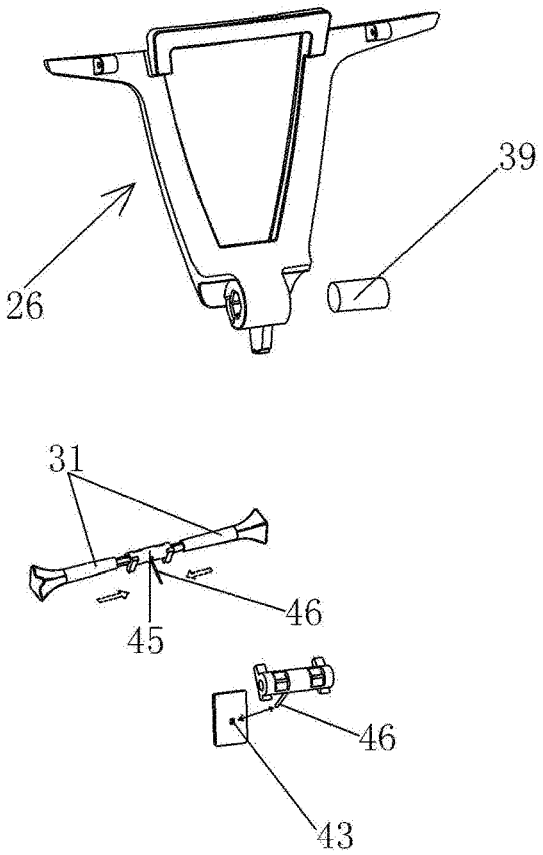
FIG. 9 is a schematic view showing a separated state of the upper back support separated from an adjusting handle and a locking sheet.
Figure 10:
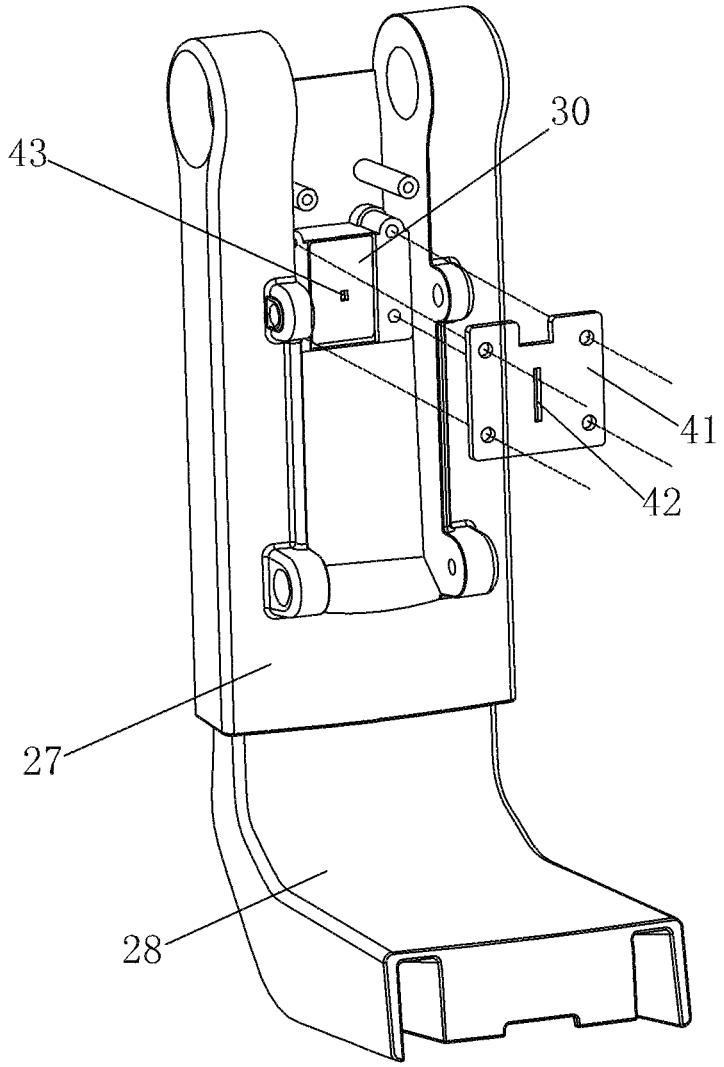
FIG. 10 is a schematic structural view of the lower back support.
Figure 11:
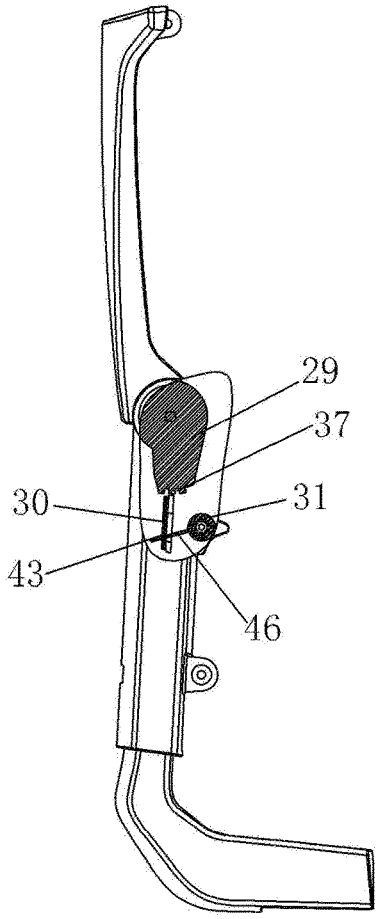
FIG. 11 is a schematic view showing a connection state of the upper back support and the lower back support when a locking mechanism is in an unlocked state.
Figure 12:
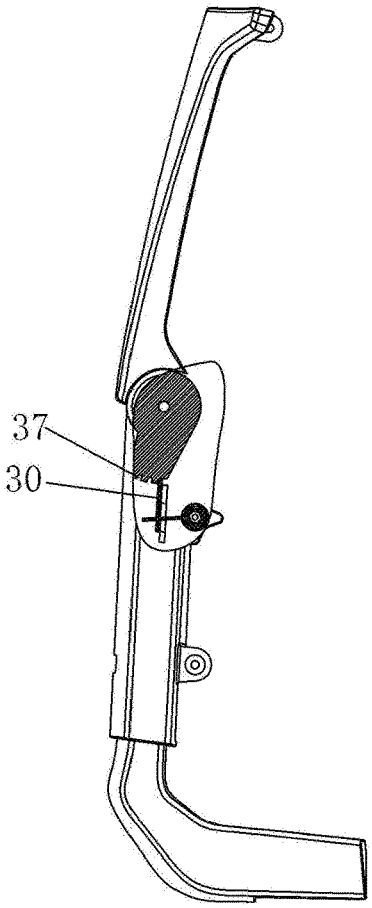
FIG. 12 is a schematic view showing that the upper back support is rotated into a position and the locking mechanism is in the locked state.

As shown in FIG. 7, FIG. 8, and FIG. 10, a plurality of slots 37 are formed in a lower end surface of the limiting block 29. Two shaft bases 38 at the lower end of the upper back support 26 and the upper end of the lower back support 27 are rotatably connected by a pin shaft 39. The limiting block 29 is located at the lower end of the pin shaft 39. A locking sheet mounting groove 40 is disposed on the lower back support 27. The locking sheet mounting groove 40 is located under the limiting block 29, and the locking sheet mounting groove 40 is covered with an end cover 41. The locking sheet 30 is located in the locking sheet mounting groove 40 and a movement gap is retained therein. An insertion port 42 has a linear shape, and is vertically disposed in the middle of the end cover 41. A pin hole 43 is provided at a center of the locking sheet 30. The adjusting handle 31 is rotatably connected to a first small shaft base 50 on both sides of the locking sheet mounting groove 40 of the lower back support 27. A pin seat 45 is sleeved on the middle of a rotating shaft 44 in a center of the adjusting handle 31. An insertion pin 46 is fixed in the center of the pin seat 45. The insertion pin 46 passes through the insertion port 42 of the end cover 41 and is inserted into the pin hole 43 of the locking sheet 30. Rotation of the adjusting handle 31 drives the insertion pin 46 to move the locking sheet 30 upward and insert into a corresponding one of the slots 37 of the limiting block for locking.

Further, the adjusting handle 31 is provided with a latch block 47 for limiting the rotation of the adjusting handle 31, and a latch slot (not shown) is correspondingly disposed on the lower back support 27. When the latch block 47 cooperates with the latch slot, the adjusting handle 31 is no longer rotated.

Figure 13:
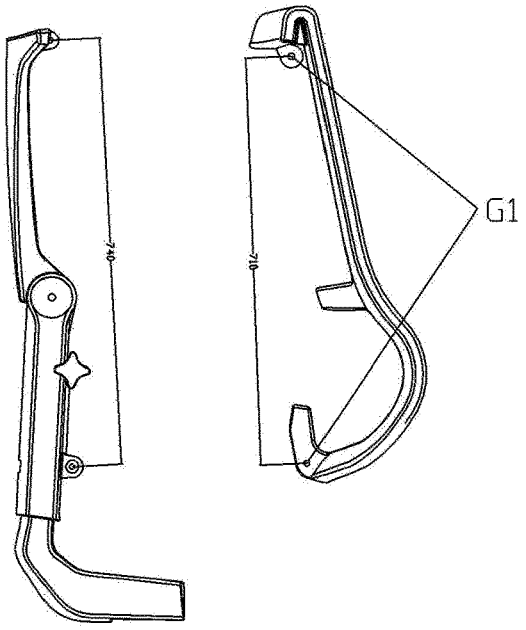
FIG. 13 is a schematic view showing a separated state of the upper back support and the lower back support separated from the seat back frame.
Figure 14:
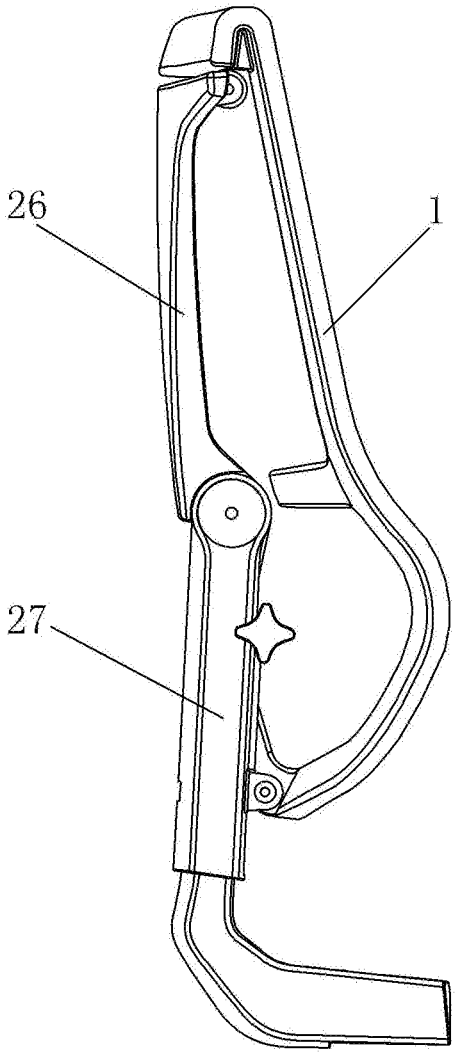
FIG. 14 is a schematic view showing an initial state of the back component.
Figure 15:
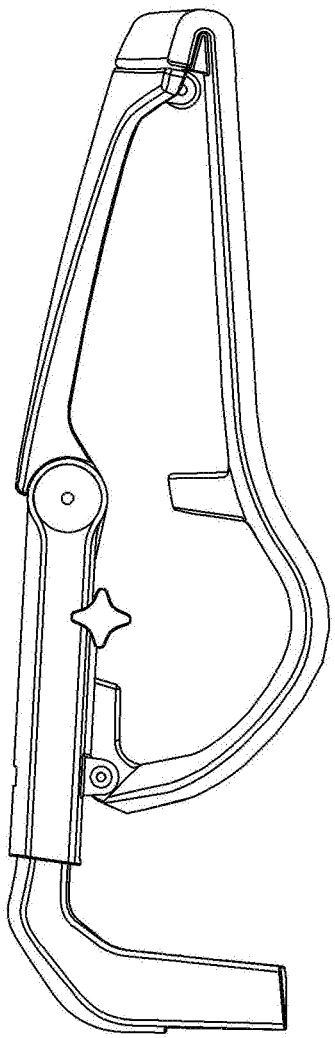
FIG. 15 is a schematic view showing that the upper back support is rotated into a position and the back component is in a locked state.

When the seat back frame 1 is installed, as shown in FIG. 13, the straight-line distance between the hinge point of the upper portion of the upper back support 26 and the hinge point of the lower portion of the lower back support 27 is 740 millimeters, and a distance between the upper and lower hinge points of the seat back frame 1 is 710 millimeters. Since the seat back frame 1 is elastic, the straight-line distance between the upper and lower hinge points of the seat back frame 1 is extendable during installation. A length of the seat back frame 1 can be forcibly extended to be hinged with the upper portion of the upper back support 26 and the lower back supports 27. When the upper back support is pushed to rotate, the seat back frame is driven to rotate and deform, and the elastic property of the seat back frame serves as a driving force for the upper back support to rotate and restore.

As shown in FIG. 16, in an initial state, a human back curve 48 does not fit a curved line of a front end of the seat back frame 1, which is clearly exhibited as a relatively large gap 49 is formed between an upper-half of the human back curve 48 and an upper portion of the seat back frame 1. When the upper back support 27 rotates forward, the upper portion of the seat back frame 1 is pushed forward, and an angle of the seat back frame 1 is changed. In the meantime, the straight-line distance of the upper and lower hinge points of the seat back frame 1 is changed, which also causes a shape of the seat back frame 1 to be changed. With the control of the adjusting handle 31, a posture of the seat back frame 1 is stabilized in a preset state. As shown in FIG. 17, after the angle and the posture of the seat back frame 1 are changed, the human back curve 48 basically fits the curved line of the front end of the seat back frame 1 to achieve the purpose of providing comfortable support.

In order to improve comfort of waist of a user, the existing mesh chair is designed in the manner that the middle of the chair back abuts against the waist of human body as much as possible; for example, some are provided with slidable lumbar support, and some are designed with improved based plate so that the chair back can always fit the waist when the human body leans backward/forward. But, these designs cost much and the structures thereof are complicated. Some chairs are designed with structural improvements to the seat back frame, so that a waist portion of the seat back frame has a forward-convex shape, and the mesh stretched on the seat back frame is formed as a forward-convex lumbar support, and that the structure is relatively simple and the waist-fitting effect can be realized by change of the shape. However, with such design, due to tension problem of the mesh, the mesh in the middle of the seat back frames becomes very loose, which reduces the elasticity of the meshed lumbar support, and the waist-fitting effect is reduced and negative result is generated. If the mesh in the middle of the seat back frame is also designed to be in a stretched state, improvement needs to be made through improving process, but which will increase the complexity of the structure and cost. In order to meet the ergonomic needs, as shown in FIG. 1, FIG. 2, FIG. 6, and FIG. 7, whole of the seat back frame 1 is designed in an S shape, and correspondingly, a mid-lower part of the seat back frame 1 has a shape bending forward to form an arched lumbar support 3 with the mesh. A middle portion of the seat back frame 1 is provided with a limiting base 4 arched backward. A middle portion of the mesh 2 is provided with a pulling base 5, and a rear end of the pulling base 5 is connected with the limiting base 4 through a pulling belt 6. The middle portion of the mesh 2 maintains a stretched state under the effect that the pulling belt 6 is stretched backward.

With the above solution, whole of the seat back frame 1 is S-shaped, which can fully meet the ergonomic size requirement. At the same time, a loose portion in the middle of the mesh is pressed by the pulling base and pulled by the pulling belt, and is stuck in the limiting base, such that the loose portion in the middle of the mesh is in a tight state, and the lumbar support formed in the mid-lower portion of the mesh is also in a tight state, which provides an effective stable support for the waist of the human body.

Specifically, the seat back frame 1 includes first and second frame sides 7, 8 that are in a vertical arrangement. A top lateral component 9 and a bottom lateral component 10 are disposed between the first and second frame sides 7, 8. The limiting base 4 is formed in the manner of extending from middle portions of the first and second frame sides 7, 8, and inclines to a mid-rear portion of the seat back frame 1. Briefly, the limiting base 4 is an arched rod, and the limiting base 4 is formed integrally with the first and second frame sides 7, 8, and the limiting base 4 is rigid. A first through hole 11 is provided in the middle of the limiting base 4 for passage of the pulling belt 6. A rear end of the pulling belt 6 is connected to an engaging rod 12 after passing through the first through hole 11. The engaging rod 12 is engages the rear end of the limiting base 4. The position of the limiting base 4 is fixed and located in the rear of the middle of the mesh. The pulling base 5 is configured to abut against (i.e., contact) the middle of the mesh and stretch the mesh backward while being connected to the pulling belt 6. The pulling belt 6 stretches the mesh backward and is limited at the position of the limiting base 4 such that the loose portion in the middle of the mesh is stretched tight. Accordingly, a mid-lower portion of the seat back frame 1 that arches forward can be in the tight state in cooperation with the mesh.

The pulling belt 6 is an annular belt. A length of the engaging rod 12 is greater than a length of the first through hole 11. The engaging rod 12 is sleeved with the rear end of the pulling belt 6 and both ends of the engaging rod 12 engage both sides of the first through hole 11 of the limiting base 4. With such structure, it is easy to make adjustment and connection.

Figure 4:
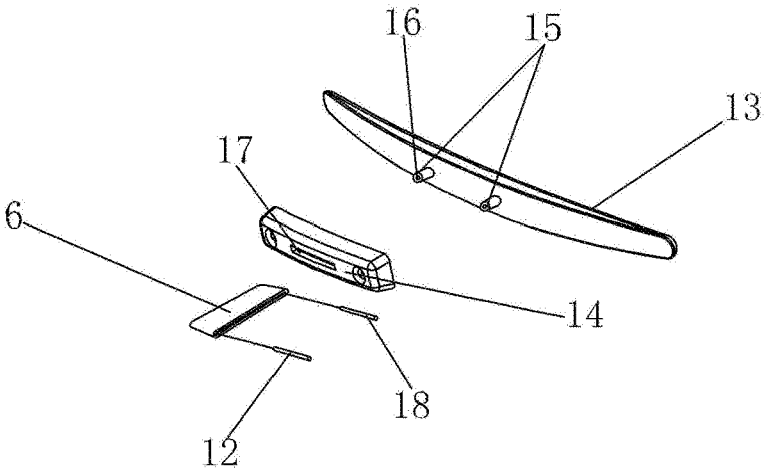
FIG. 4 is a schematic view showing a disassembled state of the pulling belt and a pulling base.
Figure 5:
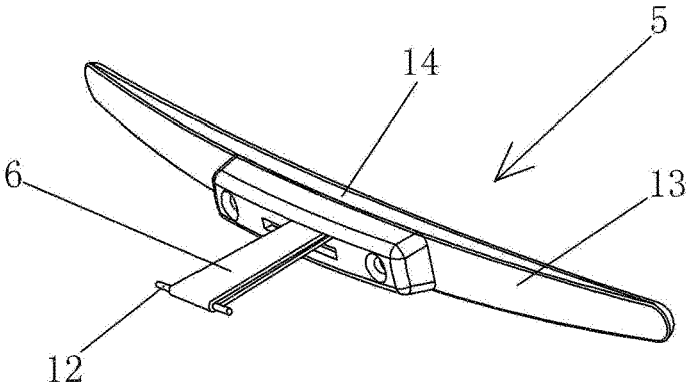
FIG. 5 is a schematic view showing an assembled state of the pulling belt and the pulling base.
Figure 6:
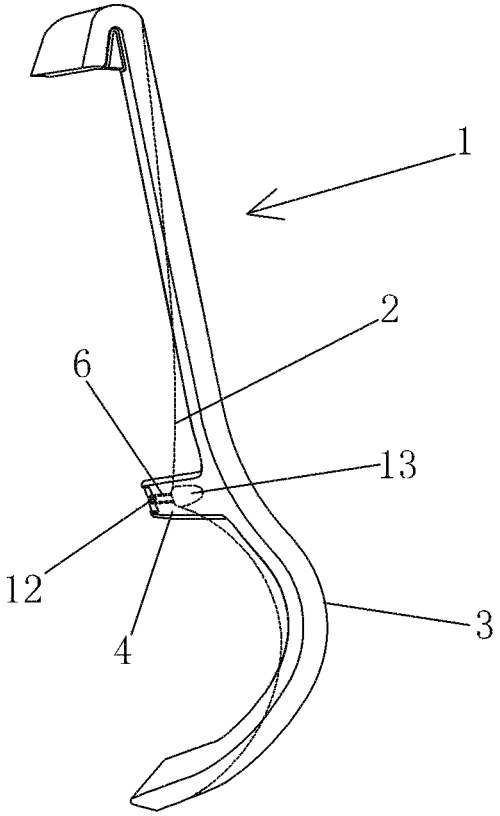
FIG. 6 is a schematic side view of FIG. 1.

As shown in FIG. 4 and FIG. 5, the pulling base 5 includes a strip 13 disposed on the front side of the middle portion of the mesh 2 and a strip fixing component 14 disposed on a rear side of the middle portion of the mesh 2. The strip 13 is in a stripped shape. In order to ensure a certain contact area and make the whole design more beautiful, a length of the strip 13 is ½ to ⅔ of a width of the seat back frame, and the length of the strip 13 is greater than a length of the strip fixing component 14. The strip fixing component 14 is fixedly connected to the middle of the strip 13, and a front end of the pulling belt 6 is limited between the strip fixing component 14 and the strip 13. It is ensured that the strip 13 has a certain length so as to increase the contact area with the mesh as much as possible. The strip 13 is strip-shaped, which does not appear to be abrupt to cause discomfort to the back of the human body. The strip 13 and the strip fixing component 14 are placed one after the other and the mesh is disposed therebetween, thereby protecting the mesh and ensuring that a middle part of mesh is pulled backward as much as possible, and it is convenient to connect the pulling belt 6 as well, thereby achieving several purposes.

The mesh loosens toward the middle portion. In order to tighten the middle portion of the mesh as much as possible, the shape of the strip 13 is in an arch shape. Both ends of the strip 13 are obliquely and forwardly extended, and a thickness of the strip 13 is gradually reduced from the middle portion to the both ends. There is a transitional change in the thickness of the strip, which compensates for defect of a backward recess caused by stretching the mesh tight backward, which makes the overall appearance more beautiful.

Specifically, two positioning columns 15 are disposed on a back surface of the strip 13, and each of the positioning columns 15 is provided with a screw hole 16. The positioning columns 15 pass through the mesh and are connected to the strip fixing component 14 with screws. The strip fixing component 14 is a box that is opened at a front end thereof. A second through hole 17 is provided at a rear end of the strip fixing component 14, the front end of the pulling belt 6 is connected to an engaging pin 18 after passing through the second through hole 17. The engaging pin 18 is stuck in the strip fixing component 14. The strip passes through the mesh via the positioning columns only so as not to cause too much destruction to the mesh while serving the function of connecting the strip fixing component.

Specifically, the length of the engaging pin 18 is greater than the length of the second through hole 17, the engaging pin 18 is sleeved with the front end of the pulling belt 6, and the both ends of the engaging pin 18 engage both sides of the second through hole 17 in the strip fixing component 14. The front end of the pulling belt can be fixed by simply making the engaging pin to sleeve with the pulling belt and retain transversely in the strip fixing component.

In practical installing and application, the two positioning columns 15 pass through the holes reserved in the middle of the mesh 2. The front end of the pulling belt 6 is stuck in the strip fixing component 14 by the engaging pin 18. The strip 13 and the strip fixing component 14 are fixed through screws to fasten and secure the mesh. Then, the pulling belt 6 is pulled backward such that the loose portion in the middle of the mesh is tightened. Thereafter, the rear end of the pulling belt 6 passes through the first through hole 11 of the limiting base 4, and the engaging rod 12 passes through the rear end of the pulling belt 6 and stuck at the rear end of the limiting base 4. Since the mesh is pulled backward due to backward pulling of the pulling belt 6 and is stuck in the limiting base 4, the mesh is maintained in a tightened state.

Finally, as shown in FIG. 1, the mesh is tightened into an S state, and a waist portion is formed into an arc state that has an "S"-shape. Of course, size and proportion of each position of the seat back frame are calculated through scientific method. The "S"-shaped curvature on a side of the seat back frame can fully meet the ergonomic size requirements and brings comfort as back support.

Although the disclosure has been disclosed by the above embodiments, the embodiments are not intended to limit the disclosure. It will be apparent to those skilled in the art that various modifications and variations can be made to the structure of the disclosure without departing from the scope or spirit of the disclosure. Therefore, the protecting range of the disclosure falls in the appended claims.

What is claimed is:

1. An ergonomic chair, comprising a back component and a seat component, wherein the back component comprises an upper back support, a lower back support, a seat back frame that is elastically deformable, and a locking mechanism for maintaining the upper back support, the lower back support, and the seat back frame at relatively fixed positions; the lower back support is connected to the seat component through a connecting rod, a lower end of the upper back support is rotatably connected to an upper end of the lower back support, and upper and lower ends of the seat back frame are respectively hinged to an upper portion of the upper back support and a lower portion of the lower back support; when the locking mechanism is unlocked, the upper back support is rotatable to change a straight-line distance between the upper and lower ends of the seat back frame, so that a shape and an angle of the seat back frame are adjusted; when the locking mechanism is locked, the upper back support, the lower back support, and the seat back frame maintain a relatively fixed posture.

2. The ergonomic chair according to claim 1, wherein the locking mechanism comprises a limiting block, a locking sheet, and an adjusting handle for controlling up-down movement of the locking sheet, the limiting block is disposed at the lower end of the upper back support, a plurality of slots are disposed on the limiting block, two shaft bases on the lower end of the upper back support and the upper end of the lower back support are pivotally connected by a pin shaft, and the limiting block is disposed at a lower end of the pin shaft; a locking sheet mounting groove is disposed on the lower back support, the locking sheet mounting groove is disposed under the limiting block, the locking sheet mounting groove is covered by an end cover, the locking sheet is disposed in the locking sheet mounting groove and a movement gap is retained, an insertion port having a linear shape is disposed on the end cover, a pin hole is disposed on the locking sheet, the adjusting handle is pivotally connected to both sides of the locking sheet mounting groove of the lower back support, an insertion pin is secured in a middle portion of the adjusting handle, the insertion pin passes through the insertion port of the end cover and is inserted into the pin hole of the locking sheet, and the adjusting handle is rotated and drives the insertion pin to move the locking sheet upward and insert into a corresponding one of the slots of the limiting block, so as to realize locking.

3. The ergonomic chair according to claim 2, wherein the adjusting handle is provided with a latch block for limiting rotation of the adjusting handle, and a latch slot is correspondingly disposed on the lower back support, and when the latch block engages the latch slot, the adjusting handle is no longer rotated.

4. The ergonomic chair according to claim 1, wherein the upper back support is an inverted triangle, the upper back support is composed of two lower vertical edges and one upper lateral edge, connecting ears are formed in the manner of extending outward from left and right ends of the upper lateral edge respectively, and the connecting ears are hinged to an upper portion of the seat back frame through a shaft.

5. The ergonomic chair according to claim 1, wherein the lower end of the seat back frame extends backward with a connecting block, and the connecting block is hinged to the lower portion of the lower back support by a shaft.

6. The ergonomic chair according to claim 1, wherein whole of the seat back frame is S-shaped, a mesh is attached to the seat back frame, a mid-lower part of the seat back frame is forwardly arched, a limiting base backwardly arched is provided in a middle portion of the seat back frame, a pulling base is disposed in a middle portion of the mesh, a rear end of the pulling base is connected to the limiting base through a pulling belt, and the mesh is maintained in a tightened state under an effect of backward stretching of the pulling belt.

7. The ergonomic chair according to claim 6, wherein the seat back frame comprises vertically disposed first and second frame sides, and a top lateral component and a bottom lateral component are disposed between the first and second frame sides, the limiting base extends from middle portions of the first and second frame sides and inclines to a mid-rear portion of the seat back frame, and converges in a middle part, the limiting base is substantially rigid, a first through hole is provided in the middle of the limiting base for passage of the pulling belt, a rear end of the pulling belt is connected to an engaging rod after passing through the first through hole, and the engaging rod engages the rear end of the limiting base.

8. The ergonomic chair according to claim 7, wherein the pulling belt is an annular belt, a length of the engaging rod is larger than a length of the first through hole, and the engaging rod is sleeved with the rear end of the pulling belt, and both ends of the engaging rod engage both sides of the first through hole of the limiting base.

9. The ergonomic chair according to claim 6, wherein the pulling base comprises a strip disposed on a front side of the middle portion of the mesh and a strip fixing component disposed on a rear side of the middle portion of the mesh, the strip is in a stripped shape, a length of the strip is greater than a length of the strip fixing component, the strip fixing component is fixedly connected to a middle portion of the strip, and a front end of the pulling belt is limited between the strip fixing component and the strip.

10. The ergonomic chair according to claim 9, wherein the shape of the strip is in an arch shape, both ends of the strip are obliquely and forwardly extended, and a thickness of the strip is gradually reduced from the middle portion to the both ends.

11. The ergonomic chair according to claim 9, wherein at least two positioning columns are disposed on a back surface of the strip, each of the positioning columns is provided with a screw hole, the positioning columns pass through the mesh and are connected to the strip fixing component with screws; the strip fixing component is a box opened at a front end thereof, a second through hole is provided at a rear end of the strip fixing component, the front end of the pulling belt is connected to an engaging pin after passing through the second through hole, and the engaging pin is stuck in the strip fixing component.

12. The ergonomic chair according to claim 11, wherein the pulling belt is an annular belt, a length of the engaging pin is greater than a length of the first through hole, the engaging pin is sleeved with the front end of the pulling belt, and the both ends of the engaging pin engage both sides of the second through hole of the strip fixing component.

13. The ergonomic chair according to claim 1, wherein whole of the seat back frame is plastic injection molded, a slot is provided around the seat back frame, and a periphery of the mesh is fixed in the slot around the seat back frame.

* * * * *